US011478763B2

(12) United States Patent
LaRose

(10) Patent No.: US 11,478,763 B2
(45) Date of Patent: Oct. 25, 2022

(54) METERED DISPENSER CATCH FOR ASYMMETRIC ROTATION MIXER

(71) Applicant: FLACKTEK, INC., Landrum, SC (US)

(72) Inventor: Ian LaRose, Greenville, SC (US)

(73) Assignee: FLACKTEK SPEEDMIXER, INC., Landrum, SC (US)

( * ) Notice: Subject to any disclaimer, the term of this patent is extended or adjusted under 35 U.S.C. 154(b) by 256 days.

(21) Appl. No.: 16/002,556

(22) Filed: Jun. 7, 2018

(65) Prior Publication Data

US 2018/0353919 A1 Dec. 13, 2018

Related U.S. Application Data

(60) Provisional application No. 62/517,616, filed on Jun. 9, 2017.

(51) Int. Cl.
*B01F 29/10* (2022.01)
*B01F 29/34* (2022.01)
*B01F 35/42* (2022.01)

(52) U.S. Cl.
CPC ..... *B01F 29/34* (2022.01); *B01F 29/10* (2022.01); *B01F 35/421* (2022.01)

(58) Field of Classification Search
CPC ..... B01F 9/0001; B01F 29/10
USPC ..... 366/213, 217; 215/302
See application file for complete search history.

(56) References Cited

U.S. PATENT DOCUMENTS 218,142 A * 8/1879 Schowe ..... F16B 23/003 411/403
281,831 A * 7/1883 Brown ..... F16B 23/003 411/403
389,167 A * 9/1888 Rogers ..... B21K 1/463 470/63
391,097 A * 10/1888 Thayer ..... F16B 23/003 411/403
659,068 A * 10/1900 Ives ..... E05F 11/00 16/220
684,799 A * 10/1901 Devoe ..... B65D 39/10 215/302
1,002,347 A * 9/1911 Werner ..... B01F 9/0018 366/213
1,018,947 A * 2/1912 Wall ..... B01F 9/0018 366/213
2,972,784 A * 2/1961 Shonka ..... B29C 43/34 264/112
3,679,184 A 7/1972 Woodham et al.
3,778,033 A 12/1973 Pullman
(Continued)

FOREIGN PATENT DOCUMENTS

EP 2457645 A1 5/2012
JP 2000246082 A 9/2000

OTHER PUBLICATIONS

Search Report for International Patent Application No. PCT/US2018/036659, dated Aug. 8, 2018.
(Continued)

*Primary Examiner* — David L Sorkin
(74) *Attorney, Agent, or Firm* — Berg Hill Greenleaf Ruscitti LLP

(57) ABSTRACT

Devices, systems, and methods for arranging metered dispensers in position within asymmetric rotation mixers for mixing substance contained within the metered dispensers.

20 Claims, 4 Drawing Sheets

(56) References Cited

U.S. PATENT DOCUMENTS

| | | | | | |
|---|---|---|---|---|---|
| 4,172,532 | A * | 10/1979 | Palsson | B65D 50/067 | 215/215 |
| 4,235,553 | A | 11/1980 | Gall | | |
| 4,266,452 | A * | 5/1981 | Crist | B25B 27/0042 | 7/100 |
| 4,497,581 | A * | 2/1985 | Miller | B01F 9/0001 | 366/208 |
| 5,224,627 | A | 7/1993 | Weag | | |
| 5,551,779 | A | 9/1996 | Gantner et al. | | |
| 6,099,160 | A | 8/2000 | Flackett | | |
| 6,733,170 | B2 * | 5/2004 | Mukasa | B01F 9/0001 | 366/139 |
| 6,755,565 | B2 * | 6/2004 | Flackett | B01F 9/0001 | 366/217 |
| 8,104,801 | B2 * | 1/2012 | Wang | H01M 50/213 | 292/163 |
| 8,485,379 | B2 * | 7/2013 | Huckby | B01F 15/0074 | 220/23.91 |
| 2003/0198126 | A1 | 10/2003 | Flackett | | |
| 2007/0002682 | A1 | 1/2007 | Vanderbilt et al. | | |
| 2007/0045219 | A1 * | 3/2007 | Nasiatka | B65D 50/067 | 215/302 |
| 2012/0076611 | A1 * | 3/2012 | Bryan | C22C 14/00 | 411/204 |

OTHER PUBLICATIONS

Partial Supplementary European Search Report for European Patent Application No. 18813859.8; dated Feb. 9, 2021.
Extended European Search Report for European Patent Application No. 18813859.8; dated May 12, 2021.

* cited by examiner

METERED DISPENSER CATCH FOR ASYMMETRIC ROTATION MIXER

CROSS-REFERENCE TO RELATED APPLICATION

This application claims benefit of U.S. provisional patent application No. 62/517,616, filed Jun. 9, 2017, entitled METERED DISPENSER CATCH FOR ASYMMETRIC ROTATION MIXER, and commonly assigned to the assignee of the present application, the disclosure of which is incorporated by reference in its entirety herein.

BACKGROUND

The present disclosure relates generally to devices, systems, and methods of mixing. More specifically, the present disclosure relates to devices, systems, and methods of dynamic mixing.

Dynamic mixing can include agitation of substances without invasive mixer components extending into the substance, such as stirring rods. Rotational mixers can include a rotation and/or or oscillation component to assist in mixing the substances. Appropriate geometries for effective and efficient mixing can depend on process variables.

SUMMARY

The present application discloses one or more of the features recited in the appended claims and/or the following features which, alone or in any combination, may comprise patentable subject matter.

According to one aspect of the present disclosure, an asymmetric rotation mixer may include a basket configured to receive a catch for holding in relative position a metered dispenser containing substance for mixing under asymmetric rotation of the metered dispenser by the basket of the asymmetric rotation mixer. In some embodiments, the catch may include a catch body configured for engagement within the basket of the asymmetric rotation mixer to receive asymmetric rotation. The catch body may be formed complimentary to the basket to maintain relative position about a primary axis of asymmetric rotation and to rotate about a secondary axis. The catch may include a cavity defined in the catch body, the cavity configured to receive and maintain the metered dispenser stationary relative to the catch body and defining a longitudinal dimension corresponding to the metered dispenser. In some embodiments, the primary axis may be vertical. In some embodiments, the longitudinal dimension of the cavity may be oriented at an angle from horizontal, the angle being within a range of 20 degrees to 70 degrees.

According to another aspect of the present disclosure, a catch for holding in relative position a metered dispenser containing substance for mixing under asymmetric rotation of a metered dispenser by a basket of an asymmetric rotation mixer, may include a catch body configured for engagement within the basket of the asymmetric rotation mixer to receive asymmetric rotation. The catch body may be formed complimentary to the basket to maintain relative position about a primary axis of asymmetric rotation and to rotate about a secondary axis. The catch may include a cavity defined in the catch body, the cavity configured to receive and maintain the metered dispenser stationary relative to the catch body and defining a longitudinal dimension corresponding to the metered dispenser. In some embodiments, the primary axis may be vertical. In some embodiments, the longitudinal dimension of the cavity may be oriented at an angle from horizontal, the angle being within a range of 20 degrees to 70 degrees.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

The drawings disclose exemplary embodiments in which like reference characters designate the same or similar parts throughout the figures of which.

DETAILED DESCRIPTION

Figure 1:
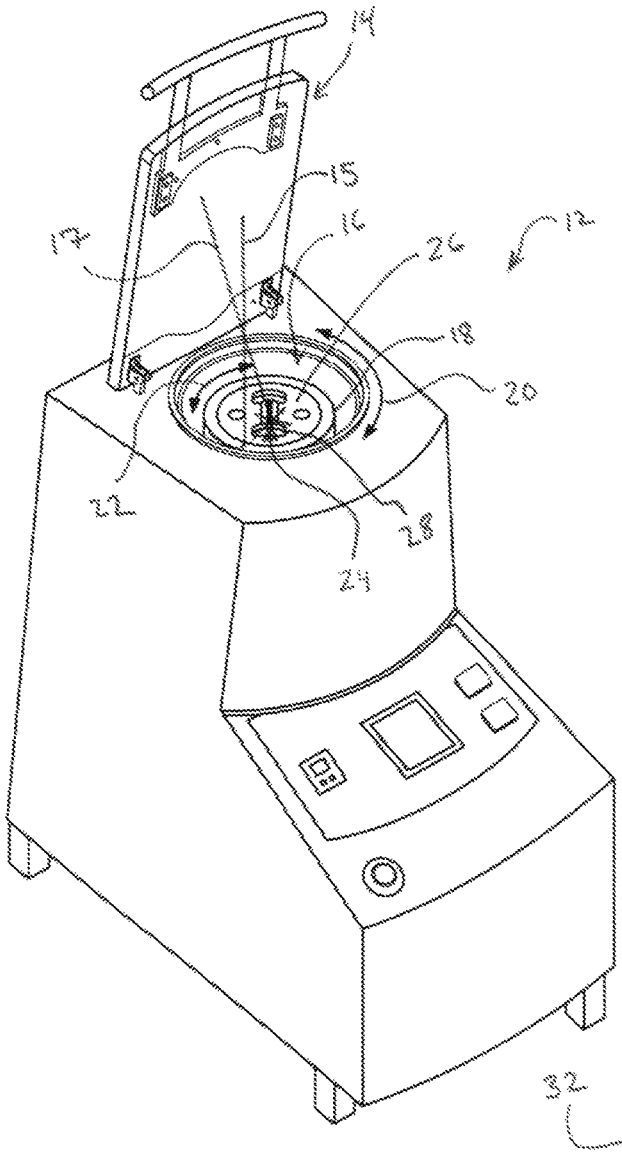
FIG. 1 is a perspective view of an asymmetric rotation mixer including a basket engaged with a catch having a dispenser held therein at an angle relative to horizontal.

For the purposes of promoting an understanding of the principles of the disclosure, reference will now be made to a number of illustrative embodiments illustrated in the drawings and specific language will be used to describe the same.

Dynamic mixing, such as rotation mixing, can provide effective, non-invasive mixing of substance. Asymmetric rotation mixing can be particularly fast and effective by imposing centrifugal (centripetal) force on the substance(s) to be mixed. Various containers can be selected for containing the substance(s) to be mixed and undergoing the asymmetric rotation.

In the illustrative embodiment as shown in FIG. 1, an asymmetric rotation mixer 12 having its hatch (door) 14 open to reveal a mixing chamber 16 for conducting asymmetric rotation mixing. The mixer 12 illustratively includes a rotation basket 18 arranged to receive mixing containers that contain one or substances for rotational mixing. The basket 18 is engaged with a rotation drive of the mixer 12 that imposes rotational forces on the basket 18 (and on mixing containers engaged with the basket 18).

In the illustrative embodiment as shown in FIG. 1, the mixer 12 is embodied as a dual axis rotation mixer. As discussed in additional detail herein, the mixer 12 illustratively rotates (or revolves; as indicated by arrows 20) the basket 18 about a primary axis 15 while simultaneously rotating the basket 18 itself about a secondary axis 17 (as indicated by arrows 22). The secondary axis 17 is illustratively defined through a centroid 24 (or center of mass) of the basket 18 (and ultimately intended to illustrate the collective centroid 24 of the basket with any received mixing container and its contents). The primary axis 15 is offset from the centroid 24 for asymmetric rotation of the basket 18 (as indicated by arrows 22).

Examples of suitable rotational mixers can be found within U.S. Pat. Nos. 6,099,160 and 6,755,565 each issued to Flackett, the disclosures of each of which are incorporated by reference herein, including, but not limited to those, portions disclosing devices, systems, and methods for mixing and associated components and accessories. Such dual axis rotation mixing including asymmetric rotation may be referred to as planetary mixing and/or centrifugal mixing, although these terms may not be entirely accurate and are not intended to limit mixing parameters such as the direction of rotation about each of the dual axes, speed, and/or other geometry relationships.

As shown in FIG. 1, the mixer 12 is shown to be seated on a level horizontal surface. In the illustrative embodiment, the primary axis 15 is vertical and the secondary axis is angled relative to the primary axis 15. In the illustrative embodiment, the basket 18 is illustratively formed as a hollow cylinder extending along the secondary axis 17 in its longitudinal dimension. The basket 18 is thus illustratively angled relative to the primary axis 15 in the same manner as the secondary axis 17.

Referring to FIG. 1, as mentioned above, the primary axis 15 is embodied to be vertical, thus perpendicular (90 degrees) to horizontal. In some embodiments, the primary axis may be within the range of about 70 to about 110 degrees from horizontal. In the illustrative embodiment, as discussed in additional detail herein relative to FIGS. 4 and 5, the secondary axis 17 (and thus the basket 18) is arranged at an angle $\alpha$ from the horizontal of about 40 degrees. A receiver (or catch) 26 is engaged within the basket 18 holding a container 28 for rotational mixing.

Figure 2:
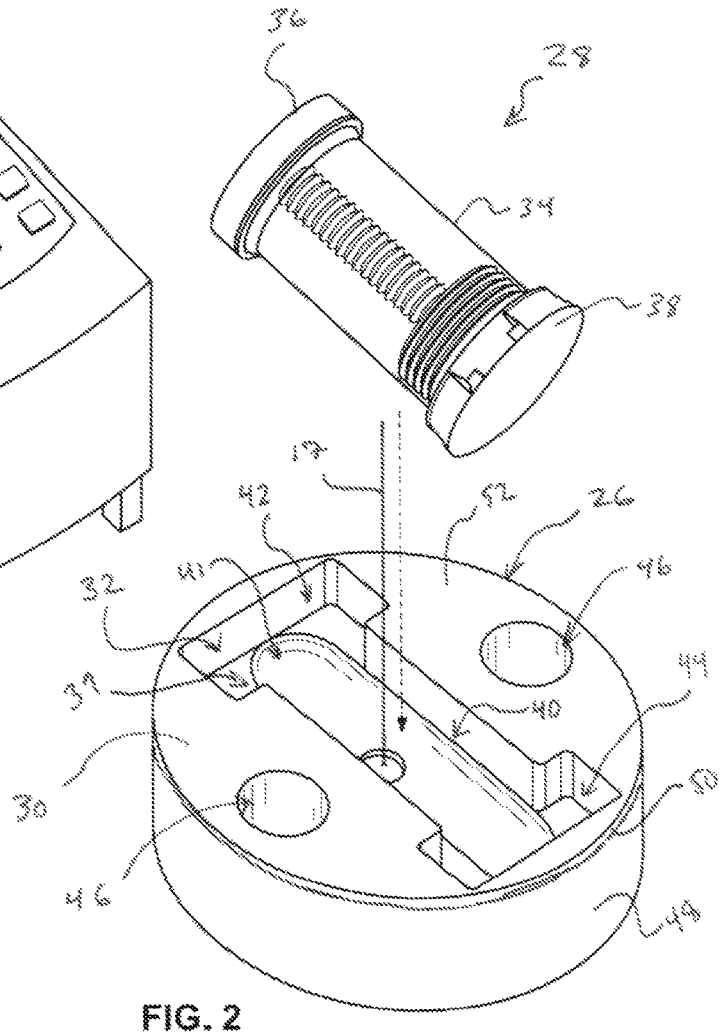
FIG. 2 is an exploded perspective view of the catch and dispenser of FIG. 1.

Referring to FIG. 2, the catch 26 is shown in exploded view with the container 28 for description purposes. The catch 26 illustratively includes a body 30 formed with a cylindrical shape having its central axis as the secondary axis 17 and extending with its longitudinal dimension oriented along the secondary axis 17 (the secondary axis 17 shown oriented vertically in FIG. 2 for description purposes). The catch 26 illustratively includes a cavity 32 defined in the body 30 and configured to receive the container 28 to maintain particular orientation during mixing as best shown in FIG. 3.

Figure 3:
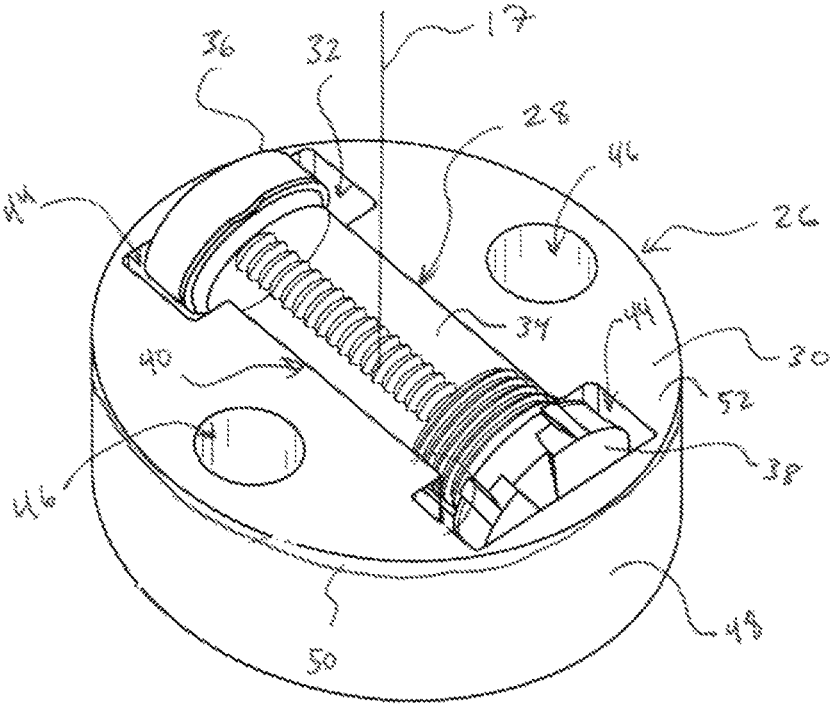
FIG. 3 is a perspective view of the dispenser received within a cavity of the catch of FIG. 2.

As shown in FIGS. 2 and 3, the container 28 is illustratively embodied as a dosing dispenser, for example, a metered dosing dispenser for accurate and precise dosing of its contents. Examples of suitable metered dispensers include Topi-CLICK® as marketed by DoseLogix® of Woodstock, Ga.; Topi-Pump® as marketed by Tcd, Inc. of Lucedale Miss.; TICKER® as marketed by Biosrx, Inc. (and/or Folsom Medical Pharmacy) of Folsom, Calif.; among others. In the illustrative embodiment, the container 28 includes a container body 34 having a generally cylindrical shape. The container body 34 illustratively extends longitudinally between opposite ends 36, 38. In the illustrative embodiment, the ends 36, 38 of the each having larger diameter than the body 34.

As illustratively shown in FIG. 3, the cavity 32 of the catch body 30 is illustratively formed complimentary to the container 28 to hold the container 28 in position. In the illustrative embodiment, the container 28 is secured within the cavity 32 by press-fitting (also referred to as friction-fit, snap-fit, and/or interference-fit), and is illustratively configured for selective securing/removal by hand. In some embodiments, the container 28 may be retained within the cavity 32 by any suitable means, for example, a fastener, such as a clip, strap, cover, and/or latch.

Returning briefly to FIG. 2, the cavity 32 illustratively includes a base channel 40 adapted to receive the container body 34, and end channels 42, 44 each adapted to receive an end 36, 38 of the container 28. In the illustrative embodiment, the base channel 40 is formed complimentary to the container body 34 to form the press-fit. In some embodiments, a press-fit may be formed between at least one end channel 42, 44 and at least one end 36, 38. The end channels 42, 44 are illustratively adapted to receive either end 36, 38 of the container 28, but in some embodiments, one or more of the end channels 42, 44 may be adapted to receive only one of the ends 36, 38.

In the illustrative embodiment as shown in FIG. 2, the cavity 32 is open on a top end face (longitudinal end face) 52 of the catch body 30 and is closed by a bottom wall 39 of the catch body 30 that defines a portion of the cavity 32. When seated within the cavity 32, the container 28 illustratively engages the bottom wall 39. The bottom wall 29 illustratively forms a depression 41 accommodating to curvature of the container 28. The cavity 32 illustratively forms an I-shape, but in some embodiments, may have any suitable shape formed to accommodate the container 28.

As shown in FIG. 3, the catch body 30 illustratively defines holes 46 therein. The holes 46 can reduce the overall weight of the catch body 30. In the illustrative embodiment, the catch body 30 includes side wall 48 having a slight taper in the downward direction (in the orientation as shown in FIG. 3) along the secondary axis 17. The taper is illustratively formed complimentary to the basket 18 which illustratively includes complimentary interior tapering. The catch 26 illustratively includes a ledge 50 extending from an outer circumference of the side wall 48 of the catch body 30 near the top end face 52 of the catch body 30.

Figure 4:
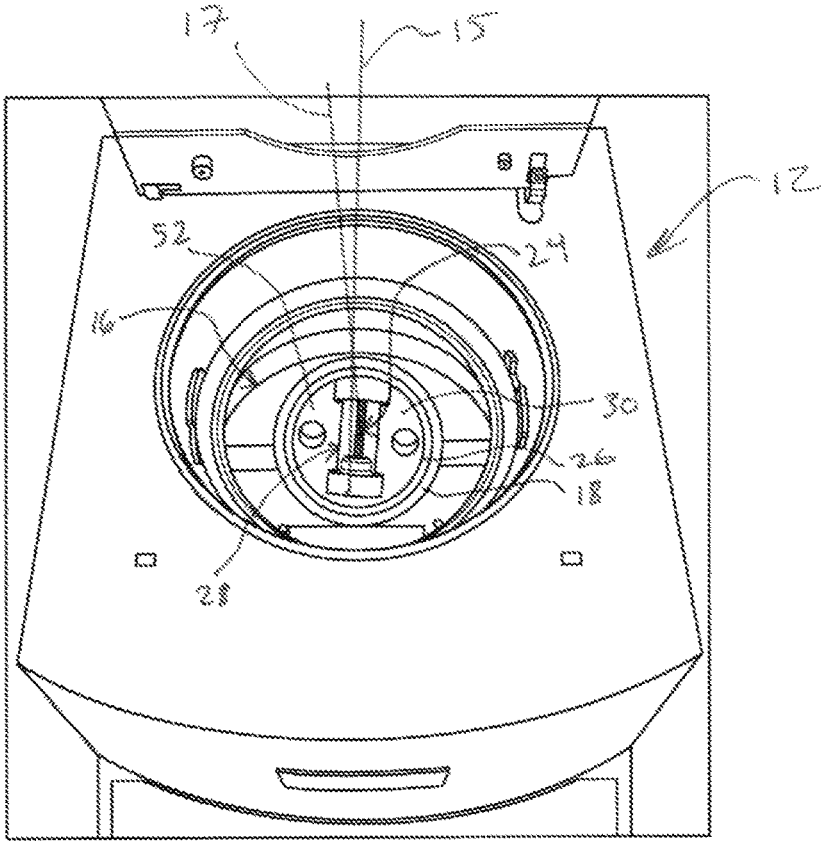
FIG. 4 is an overhead perspective view of the mixer of FIG. 1.

As shown in FIG. 4, as mentioned above, the basket 18 is illustratively arranged to have the secondary axis 17 angled relative to horizontal (and angled relative to the primary axis 15). In FIG. 4, the offset between the centroid 24 and the axis 15 can better observed to create asymmetric rotation of the basket 18 thereabout.

Figure 5:
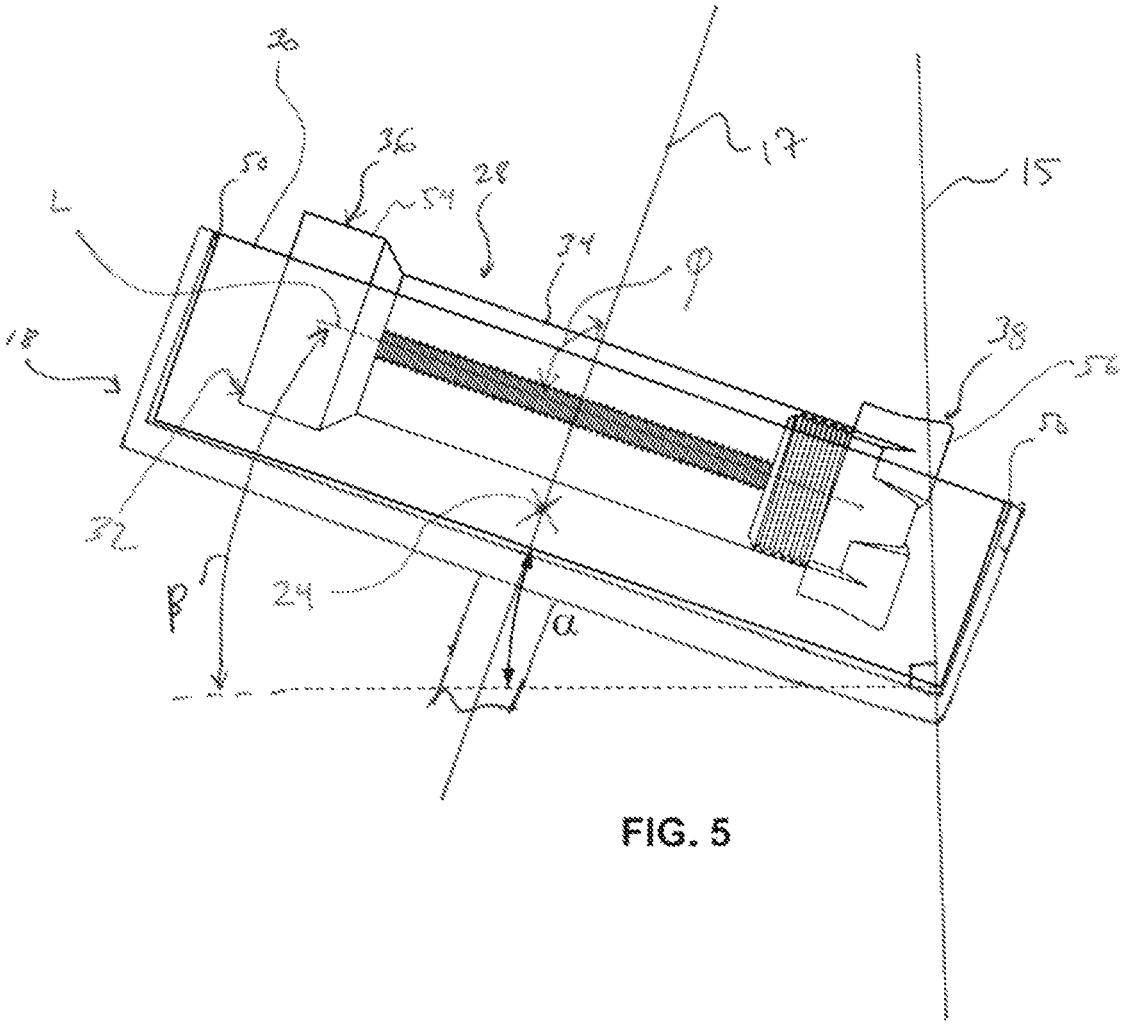
FIG. 5 is a side elevation view of the dispenser received within a cavity of the catch of FIG. 3.

Referring to FIG. 5, the angle $\alpha$ between the basket 18 and horizontal (dashed line) is illustrated in a side elevation view for clarity. As mentioned above, the basket 18 (and accordingly, the catch 26 and the container 28) by its secondary axis 17 is arranged at the angle $\alpha$ relative to the horizontal of about 40 degrees, but in some embodiments, the angle $\alpha$ from the horizontal may be within the range of about 1 to about 89 degrees. Angling the container 28 for dual axis rotation can provide efficiency and effectiveness in mixing its contents.

As shown in the illustrative embodiment of FIG. 5, the end 36 of the container 28 is formed as a lid 54. The lid 54 is illustratively selectively secured to the body 34 by snap-fit engagement, but in some embodiments, may be secured by any suitable means. The lid 54, as secured in place, illustratively covers the longitudinal end of the container body 34 which includes at least one opening for dispensing contents from within the container body 34. The end 36 of the container 28 illustratively includes an adjustment dial 56 for incremental rotation to turn a screw shaft extending through the container body 34 to drive a plunger under controlled length to deliver contents of the container body through the at least one opening for metered dispensing. Other dispenser designs, methods, and/or arrangements may be used as discussed above. The longitudinal dimension of the container 28 is illustrated for clarity as line L having the lid 54 and dial 56 at opposite ends thereof.

As shown in FIG. 5, the cavity 32 formed in the catch body 30 receives the container 28 to maintain the longitudinal dimension L of the container 28 at an angle β relative to the horizontal. In the illustrative embodiment, the angle β relative to the horizontal is equal to the angle α, but in some embodiments, may be any suitable angle within the range of about 1 to about 89 degrees. Angling the container 28 relative to horizontal can provide advantageous geometries for mixing substance(s) within the container 28.

In FIG. 5, the primary axis 15 is shown offset from the centroid 24 extending through portions of the basket 18, catch 26, and container 28, but in some embodiments, may have a greater offset such that the primary axis 15 does not extend through any portions of the basket 18, catch 26, and container 28. As mentioned previously, the offset creates the asymmetry in rotation about the primary axis 15. Together with the speed of rotation about the axis 15, the offset (radius of rotation) and the angle β of the container 28 determine the amount of centrifugal (centripetal) force applied to the substance(s) to be mixed within the container 28. Other factors effecting mixing forces may include container shape/size and rotation direction. In the illustratively embodiment, the offset is within the range of about 3 to about 60 centimeters. The speed of rotation about the primary axis 15 is illustratively within the range of about 300 to about 1200 RPM, but in some embodiments, may be within the range of about 50 to about 3500 RPM.

In the illustrative embodiment, the rotation speed about the secondary axis 17 is proportional to the speed about the primary axis 15 at a ratio within the range of about 1:1 to about 1:5 (primary:secondary), but in some embodiments, may be in the range of about 1:0.9 to about 1:2.0. In some embodiments, the rotation speed about the secondary axis 17 may be independent. In the illustrative embodiment, the rotation about the primary axis 15 is clockwise (viewed from above, such as in FIG. 4) and rotation about the secondary axis 17 is counter clockwise, but in some embodiments, the direction of rotation for either primary and secondary axes 15, 17 may be either clockwise or counter clockwise. As shown in FIG. 5, a drive shaft connects with the basket 18 to drive rotation, but in some embodiments, any suitable drive may be used.

Container 28 is illustratively formed of plastic. In some embodiments, the container 28 may include any suitable material, for example, polypropylene, polyethylene, polystyrene, polyurethane, tin, aluminum, steel, and/or silicon dioxide. The volume of substance within the container is illustratively within the range of about 0.1 ml to about 20000 ml.

Figure 6:
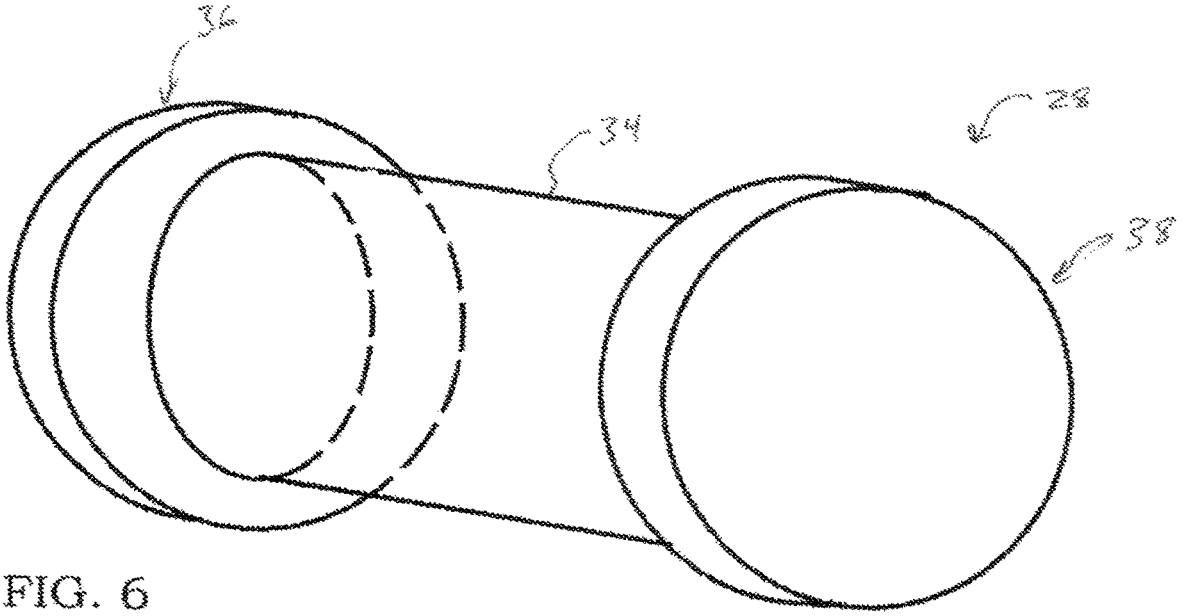
FIG. 6 is a another perspective view of the dispenser of FIGS. 1-5; and, FIG. 7 is another perspective view of the mixer of FIG. 1 showing the basket exaggerated out from the mixing cavity to emphasis its angle relative to horizontal.
Figure 7:
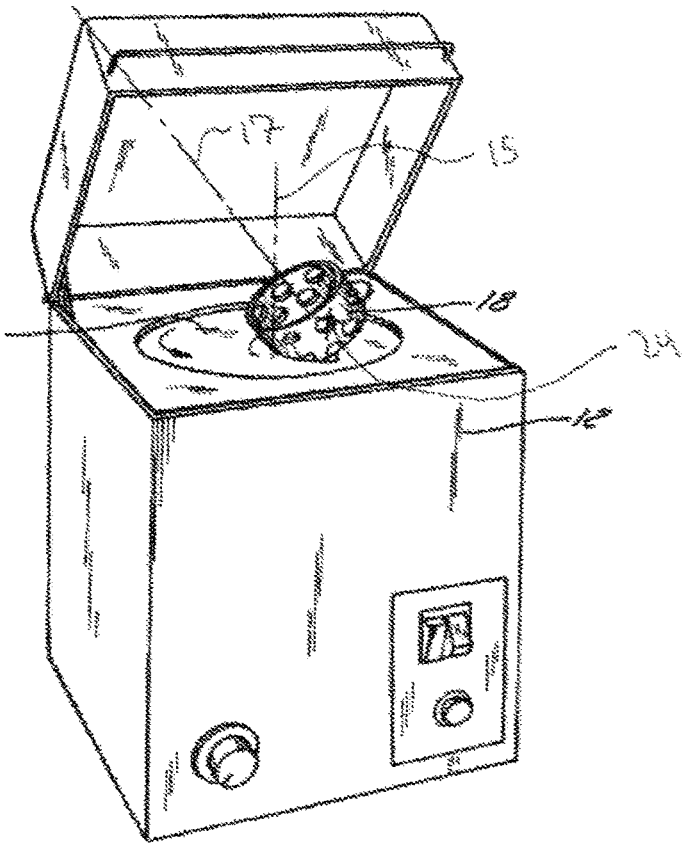
PRIOR ART FIG. 7

As shown in FIG. 6, the container 28 is shown empty and having body 34 partly transparent to show that the body 34 illustratively includes an ovular shape. The cavity 32, namely the base channel 40 is illustratively formed to receive the container such that the larger dimension of the ovular shape is oriented generally vertically, but in some embodiments, may be oriented otherwise. FIG. 7 shows the mixer 12 having the basket 18 exaggerated out from the chamber 16 to illustrate the offset between the primary axis 15 and the centroid 24, and the angle of the basket 18 relative to horizontal.

The present disclosure include devices, systems, and methods for maintaining mixing containers at a specific position relative to horizontal to provide geometric advantages in rotational mixing. In some embodiments, the basket 18 may be omitted and the catch 26 engaged directly with the drive of the mixer 12. The foregoing descriptions of the angle β of the container 28 relative to horizontal can alternatively be expressed as an angle φ between line L and secondary axis 17. Angle φ is illustratively about 90 degrees, but in some embodiments, the angle φ can be any value from about 0 to about 179 degrees. Angles herein may be expressed relative any particular reference frame.

An aspect of the present disclosure may include any one or more of the following clauses: a mixer catch for holding in relative position a metered dispenser containing substance for mixing under asymmetric rotation of the metered dispenser by a basket of an asymmetric rotation mixer. The mixer catch may include a catch body configured for engagement within the basket of the asymmetric rotation mixer to receive asymmetric rotation. The catch body may be formed complimentary to the basket to maintain relative position about a primary axis of asymmetric rotation and to rotate about a secondary axis. A cavity may be defined in the catch body. The cavity may be configured to receive and maintain the metered dispenser stationary relative to the catch body and to define a longitudinal dimension corresponding to the metered dispenser. In some embodiments, the primary axis may be vertical. In some embodiments, the longitudinal dimension of the cavity may be oriented at an angle from horizontal, the angle being within a range of about 20 degrees to about 70 degrees. In some embodiments, the angle may be within the range of about 30 to about 50 degrees.

In some embodiments, the primary axis may extend through the catch body. The primary axis is offset from a centroid of the catch body by a distance within the range of about 3 to about 20 centimeters. The catch body may be formed to have a cylindrical shape extending along the secondary axis. The catch body may be tapered for at least a portion of its extent along the secondary axis. In some embodiments, the catch body may include a circumferential ledge formed on an upper end.

In some embodiments, the cavity may be formed to have an I shape. The cavity may be defined at least partly by an endwall having a depression formed therein. In some embodiments, the dispenser may have an ovular cross-section and the depression includes curvature formed to accommodate the dispenser.

Another aspect of the present disclosure may include one or more of the following clauses: an asymmetric rotation mixer may include a basket for holding in relative position a receptacle containing substance for mixing under asymmetric rotation about a primary axis of asymmetric rotation and about a secondary axis of asymmetric rotation. The mixer may include a mixer catch including a catch body configured for engagement within the basket to receive asymmetric rotation. The catch body may formed complimentary to the basket to maintain relative position about the primary axis of asymmetric rotation and to rotate about the secondary axis. A cavity may be defined in the catch body, the cavity configured to receive and maintain the receptacle stationary relative to the catch body and to define a longitudinal dimension corresponding to the receptacle. In some embodiments, the primary axis may be vertical. In some embodiments, the longitudinal dimension of the cavity may be oriented at an angle from horizontal, the angle being within a range of about 20 to about 70 degrees. In some embodiments, the angle may be within the range of 30 to 50 degrees.

In some embodiments, the primary axis may extend through the catch body. The primary axis may be offset from a centroid of the catch by a distance within the range of about 3 to about 20 centimeters. In some embodiments, the speed of rotation about the primary axis may be within the range of about 300 to about 1200 RPM. In some embodiments, the speed of rotation about the secondary axis may be proportional to the speed of rotation of about the primary axis by a ratio within the range of about 1:1 to about 1:3. Rotation about the primary axis may be clockwise. Rotation about the primary axis may counter clockwise. In some embodiments, the metered dispenser may contain a volume of substance for mixing within the range of about 0.1 to about 20000 ml.

Another aspect of the present disclosure may include one or more of the following clauses: a method of asymmetrical rotation mixing may include arranging a metered dispenser within a complimentary cavity of a mixer catch, and rotating the catch about a primary axis and about a secondary axis oriented at an angle relative to the primary axis within the range of about 40 to about 60 degrees. A longitudinal dimension of the dispenser may be arranged generally perpendicular to the secondary axis.

The following numbered clauses include embodiments that are contemplated and non-limiting:

Clause 1: A mixer catch for holding in relative position a metered dispenser containing substance for mixing under asymmetric rotation of the metered dispenser by a basket of an asymmetric rotation mixer, the mixer catch comprising: (a) a catch body configured for engagement within the basket of the asymmetric rotation mixer to receive asymmetric rotation, the catch body formed complimentary to the basket to maintain relative position about a primary axis of asymmetric rotation and to rotate about a secondary axis; and (b) a cavity defined in the catch body, the cavity configured to receive and maintain the metered dispenser stationary relative to the catch body and defining a longitudinal dimension corresponding to the metered dispenser, wherein the primary axis is vertical and the longitudinal dimension of the cavity is oriented at an angle from horizontal, the angle being within a range of about 20 degrees to about 70 degrees.

Clause 2: The mixer catch of Clause 1, wherein the angle is within the range of about 30 to about 50 degrees.

Clause 3: The mixer catch of Clause 1, wherein the primary axis extends through the catch body.

Clause 4: The mixer catch of Clause 1, wherein the primary axis is offset from a centroid of the catch body by a distance within the range of about 3 to about 20 centimeters.

Clause 5: The mixer catch of Clause 1, wherein the catch body is formed to have a cylindrical shape extending along the secondary axis.

Clause 6: The mixer catch of Clause 5, wherein the catch body is tapered for at least a portion of its extent along the secondary axis.

Clause 7: The mixer catch of Clause 6, wherein the catch body includes a circumferential ledge formed on an upper end.

Clause 8: The mixer catch of Clause 1, wherein the cavity is formed to have an I shape.

Clause 9: The mixer catch of Clause 1, wherein the cavity is defined at least partly by an endwall having a depression formed therein.

Clause 10: The mixer catch of Clause 9, wherein the dispenser has an ovular cross-section and the depression includes curvature formed to accommodate the dispenser.

Clause 11: An asymmetric rotation mixer comprising: (a) a basket for holding in relative position a receptacle containing substance for mixing under asymmetric rotation about a primary axis of asymmetric rotation and about a secondary axis of asymmetric rotation; (b) a mixer catch including a catch body configured for engagement within the basket to receive asymmetric rotation, the catch body formed complimentary to the basket to maintain relative position about the primary axis of asymmetric rotation and to rotate about the secondary axis; and (c) a cavity defined in the catch body, the cavity configured to receive and maintain the receptacle stationary relative to the catch body and defining a longitudinal dimension corresponding to the receptacle, wherein the primary axis is vertical and the longitudinal dimension of the cavity is oriented at an angle from horizontal, the angle being within a range of about 20 to about 70 degrees.

Clause 12: The asymmetric rotation mixer of Clause 11, wherein the angle is within the range of 30 to 50 degrees.

Clause 13: The asymmetric rotation mixer of Clause 11, wherein the primary axis extends through the catch body.

Clause 14: The asymmetric rotation mixer of Clause 11, wherein the primary axis is offset from a centroid of the catch by a distance within the range of about 3 to about 20 centimeters.

Clause 15: The asymmetric rotation mixer of Clause 11, wherein the speed of rotation about the primary axis is within the range of about 300 to about 1200 RPM.

Clause 16: The asymmetric rotation mixer of Clause 15, wherein the speed of rotation about the secondary axis is proportional to the speed of rotation of about the primary axis by a ratio within the range of about 1:1 to about 1:3.

Clause 17: The asymmetric rotation mixer of Clause 11, wherein rotation about the primary axis is clockwise.

Clause 18: The asymmetric rotation mixer of Clause 11, wherein rotation about the primary axis is counter clockwise.

Clause 19: The asymmetric rotation mixer of Clause 11, wherein the metered dispenser contains a volume of substance for mixing within the range of about 0.1 to about 20000 ml.

Clause 20: A method of asymmetrical rotation mixing comprising: (a) arranging a metered dispenser within a complimentary cavity of a mixer catch; and (b) rotating the catch about a primary axis and about a secondary axis oriented at an angle relative to the primary axis within the range of about 40 to about 60 degrees, wherein a longitudinal dimension of the dispenser is arranged generally perpendicular to the secondary axis.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

The invention claimed is:

1. A system for asymmetrical mixing comprising:

an asymmetric rotation mixer having a rotation drive;

a basket engaged with the rotation drive of the asymmetric rotation mixer and configured to receive rotational force about a primary axis;

metered dispenser having a body and two opposing ends;

mixer catch having:

a catch body configured for engagement within the basket , the catch body formed complimentary to the basket to maintain relative position about the primary axis of asymmetric rotation and to rotate about a secondary axis;

a cavity defined in the catch body, the cavity positioned on the top surface of said catch body and further configured to receive the metered dispenser such that both opposing ends are secured within said cavity, and wherein the longitudinal dimension extends along a top face of the catch body and further extends through a centroid of the catch body and wherein the cavity is further configured to maintain the metered dispenser stationary relative to the catch body and defining a longitudinal dimension corresponding to a longitudinal extent of the metered dispenser, wherein the longitudinal dimension extends along a top face of the catch body; and wherein the primary axis is vertical and the longitudinal dimension of the cavity is oriented at an angle from horizontal, the angle being within a range of about 20 degrees to about 70 degrees.

2. The system of claim 1, wherein the angle is within the range of about 30 to about 50 degrees.

3. The system of claim 1, wherein the primary axis extends through the catch body.

4. The system of claim 1, wherein the primary axis is offset from a centroid of the catch body by a distance within the range of about 3 to about 20 centimeters.

5. The system of claim 1, wherein the catch body is formed to have a cylindrical shape extending along the secondary axis.

6. The system of claim 5, wherein the catch body is tapered for at least a portion of its extent along the secondary axis.

7. The system of claim 6, wherein the catch body includes a circumferential ledge formed on an upper end.

8. The system of claim 1, wherein the cavity is formed to have an I shape.

9. The system of claim 1, wherein the cavity is defined at least partly by an end wall having a depression formed therein.

10. The system of claim 9, wherein the dispenser has an ovular cross-section and the depression includes curvature formed to accommodate the metered dispenser.

11. An asymmetric rotation mixer comprising:

a rotation drive configured for providing rotational force for mixing;

a substance to be mixed under asymmetric rotation;

a receptacle, comprising a metered dispenser having a body and two opposing ends containing said substance to be mixed under asymmetric rotation about a primary axis of asymmetric rotation and about a secondary axis of asymmetric rotation;

a basket engaged with said rotation drive to receive rotational force about said primary axis;

a mixer catch including a catch body configured for engagement within said basket to receive asymmetric rotation, said catch body formed complimentary to said basket to maintain relative position about said primary axis of asymmetric rotation and to rotate about said secondary axis;

a cavity defined in said catch body, the cavity configured to receive said receptacle such that both opposing ends are secured within said cavity and further maintain said receptacle stationary relative to said catch body and defining a longitudinal dimension corresponding to a longitudinal extent of said receptacle, wherein said longitudinal dimension extends along a top face of said catch body, such that the top portion of said receptacle is externally positioned and not encased by said cavity; and wherein said primary axis is vertical and said longitudinal dimension of the cavity is oriented at an angle from horizontal, said angle being within a range of about 20 to about 70 degrees.

12. The asymmetric rotation mixer of claim 11, wherein said angle is within the range of 30 to 50 degrees.

13. The asymmetric rotation mixer of claim 11, wherein said primary axis extends through said catch body.

14. The asymmetric rotation mixer of claim 11, wherein said primary axis is offset from a centroid of the catch by a distance within the range of about 3 to about 20 centimeters.

15. The asymmetric rotation mixer of claim 11, wherein the speed of rotation about the primary axis is within the range of about 300 to about 1200 RPM.

16. The asymmetric rotation mixer of claim 15, wherein the speed of rotation about the secondary axis is proportional to the speed of rotation of about the primary axis by a ratio within the range of about 1:1 to about 1:3.

17. The asymmetric rotation mixer of claim 11, wherein rotation about said primary axis is clockwise.

18. The asymmetric rotation mixer of claim 11, wherein rotation about said primary axis is counter clockwise.

19. The asymmetric rotation mixer of claim 11, wherein said receptacle holds a volume of said substance for mixing within the range of about 0.1 to about 20000 ml.

20. The asymmetric rotation mixer of claim 11, wherein the top portion of said receptacle extends beyond the top surface of the mixer catch.

* * * * *